US007955234B1

(12) United States Patent
Pursley

(10) Patent No.: US 7,955,234 B1
(45) Date of Patent: Jun. 7, 2011

(54) EXERCISE DEVICE AND METHOD

(76) Inventor: Michael G. Pursley, Tucson, AZ (US)

( * ) Notice: Subject to any disclaimer, the term of this patent is extended or adjusted under 35 U.S.C. 154(b) by 0 days.

(21) Appl. No.: 12/038,743

(22) Filed: Feb. 27, 2008

Related U.S. Application Data

(60) Provisional application No. 60/903,906, filed on Feb. 28, 2007.

(51) Int. Cl.
*A63B 21/008* (2006.01)
*A63B 21/00* (2006.01)

(52) U.S. Cl. ..... 482/112; 482/133; 482/138

(58) Field of Classification Search ..... 482/72, 482/92, 111, 112, 113, 133, 134, 135, 136, 482/137, 138
See application file for complete search history.

(56) References Cited

U.S. PATENT DOCUMENTS

| | | | | | |
|---|---|---|---|---|---|
| 1,217,292 | A | | 2/1917 | Firth | |
| 3,465,592 | A | * | 9/1969 | Perrine | 482/5 |
| 3,747,924 | A | | 7/1973 | Champoux | |
| 3,970,302 | A | | 7/1976 | McFee | |
| D242,732 | S | * | 12/1976 | Brentham | D21/676 |
| 4,001,323 | A | | 1/1977 | Felder et al. | |
| 4,031,318 | A | | 6/1977 | Pitre | |
| 4,044,048 | A | | 8/1977 | Felder et al. | |
| 4,063,726 | A | * | 12/1977 | Wilson | 482/5 |
| 4,139,605 | A | | 2/1979 | Felder et al. | |
| 4,246,164 | A | | 1/1981 | Felder et al. | |
| 4,278,808 | A | | 7/1981 | Felder et al. | |
| 4,291,787 | A | | 9/1981 | Brentham | |
| 4,348,377 | A | | 9/1982 | Felder et al. | |
| 4,352,788 | A | | 10/1982 | Felder et al. | |
| 4,396,188 | A | | 8/1983 | Dreissigacker et al. | |
| 4,465,274 | A | * | 8/1984 | Davenport | 482/113 |
| 4,531,727 | A | | 7/1985 | Pitre | |
| 4,629,185 | A | * | 12/1986 | Amann | 482/113 |
| 4,728,099 | A | | 3/1988 | Pitre | |
| 4,739,919 | A | | 4/1988 | Van Den Brekel et al. | |
| 4,750,735 | A | * | 6/1988 | Furgerson et al. | 482/73 |
| 4,793,805 | A | | 12/1988 | Pitre | |
| 4,854,868 | A | | 8/1989 | Pitre | |
| 4,883,268 | A | * | 11/1989 | Salkind | 482/73 |
| 4,905,303 | A | | 2/1990 | Johnson, Jr. et al. | |
| 4,928,422 | A | | 5/1990 | Pitre | |
| 4,943,051 | A | | 7/1990 | Haskins et al. | |
| 5,074,550 | A | * | 12/1991 | Sloan | 482/29 |
| 5,090,694 | A | | 2/1992 | Pauls et al. | |
| 5,104,119 | A | * | 4/1992 | Lynch | 482/5 |
| 5,108,093 | A | * | 4/1992 | Watterson | 482/70 |
| 5,147,265 | A | | 9/1992 | Pauls et al. | |
| 5,163,888 | A | | 11/1992 | Stearns | |
| 5,226,866 | A | | 7/1993 | Engel et al. | |
| 5,235,112 | A | | 8/1993 | Nadler et al. | |
| 5,304,108 | A | | 4/1994 | Denega et al. | |
| 5,324,246 | A | * | 6/1994 | Wang | 482/133 |
| 5,336,473 | A | | 8/1994 | Nadler et al. | |
| D352,534 | S | | 11/1994 | Dreibelbis et al. | |
| 5,509,878 | A | | 4/1996 | Denega et al. | |

(Continued)

*Primary Examiner* — Loan Thanh
*Assistant Examiner* — Daniel F Roland
(74) *Attorney, Agent, or Firm* — Lawrence R. Oremland, P.C.

(57) ABSTRACT

A new and useful exercise device and method are provided, designed to provide a user with an exercise workout with significant core exercise benefits, from a single exercise device. The device and method of the present invention enable a user to perform at least 8 exercise movements, with variable resistance applied to each exercise movement. The 8 exercise movements are (a) bench press and row, (b) military press and lat pull down, (c) crunch and dead lift, and (d) step and leg raise.

2 Claims, 10 Drawing Sheets

U.S. PATENT DOCUMENTS 5,542,893 A 8/1996 Petersen et al.
5,580,450 A 12/1996 Lombas et al.
5,621,598 A 4/1997 Pitre, Jr. et al.
5,622,527 A * 4/1997 Watterson et al. ..... 482/53
5,658,227 A 8/1997 Stearns
5,700,858 A 12/1997 Deir et al.
5,743,678 A 4/1998 Pitre
5,795,270 A 8/1998 Woods et al.
D399,730 S 10/1998 Pitre
5,836,859 A * 11/1998 Van Herle ..... 482/112
5,908,373 A 6/1999 Pitre
5,961,423 A 10/1999 Sellers
5,971,895 A 10/1999 Habing
D417,139 S 11/1999 Pitre
5,992,253 A 11/1999 Petersen
5,997,446 A 12/1999 Stearns
6,080,088 A 6/2000 Petersen et al.
6,086,580 A 7/2000 Mordon et al.
6,139,689 A 10/2000 Polston et al.
6,155,523 A 12/2000 Pitre
6,226,880 B1 5/2001 Pitre
6,237,308 B1 5/2001 Quintin et al.
6,287,549 B1 9/2001 Sumian et al.
6,302,832 B1 10/2001 Stearns
6,340,495 B1 1/2002 Sumian et al.
6,358,889 B2 3/2002 Waggenspack et al.
6,370,161 B1 4/2002 Ehrlich et al.
6,402,667 B1 * 6/2002 Dahn ..... 482/121
D471,436 S 3/2003 Marieton et al.
6,598,078 B1 7/2003 Ehrlich et al.
6,631,605 B1 10/2003 Quintin et al.
6,666,801 B1 * 12/2003 Michalow ..... 482/137
6,794,053 B2 9/2004 Quintin et al.
7,276,018 B2 * 10/2007 Studdard ..... 482/142
7,569,003 B1 * 8/2009 Huffman ..... 482/112
7,575,539 B2 * 8/2009 Kessler ..... 482/138
2004/0162195 A1 * 8/2004 Habing ..... 482/100
2006/0084555 A1 * 4/2006 Garner ..... 482/112
2006/0148625 A1 * 7/2006 Garner ..... 482/123
2007/0219072 A1 * 9/2007 Kessler ..... 482/112
2008/0081745 A1 * 4/2008 Sargen et al. ..... 482/98
2008/0214371 A1 * 9/2008 Alexander ..... 482/137

* cited by examiner 125
114c
123
125
123a

121

125
123a
125
123

129

127
120b

126b 127
120

126a

FIG. 9b
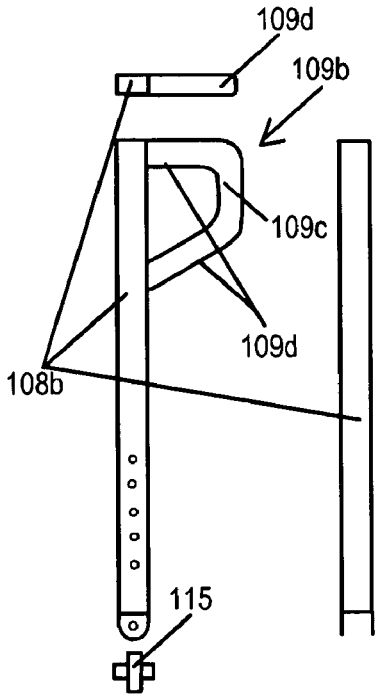
FIG. 9e
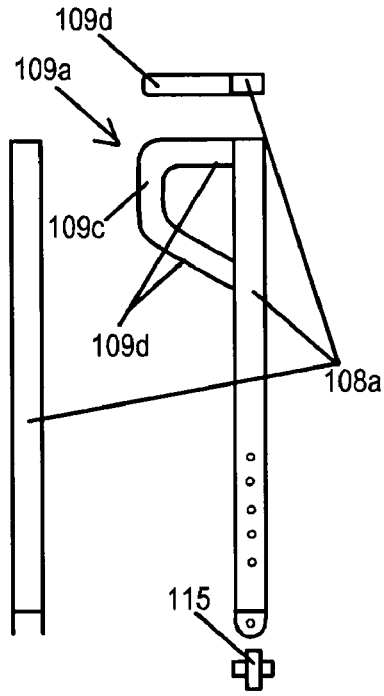
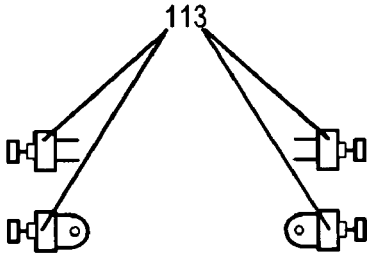
FIG. 9a FIG. 9c
FIG. 9f FIG. 9d

EXERCISE DEVICE AND METHOD

RELATED APPLICATION CLAIM OF PRIORITY

This application is related to and claims priority from provisional application Ser. No. 60/903,906, entitled Exercise Device and Method, filed Feb. 28, 2007, which provisional application is incorporated by reference herein.

BACKGROUND AND SUMMARY OF THE INVENTION

The present invention provides a new and useful exercise device and method designed to provide a user with an exercise workout on a single device that enables the user to get significant exercise benefits.

In the applicant's experience, prior to the present invention, one of the best exercise devices available to provide a user with significant exercise benefits, in a workout of relatively short duration, is the ROM device. That device provides a user with at least 6 important exercise movements, sometimes referred to herein as core exercise movements, and enables a user to obtain a workout that incorporates those exercise movements, in a relatively short amount of time. Those core exercise movements are bench press, row, crunch, dead lift, leg step and raise.

The ROM device has a flywheel that produces variable resistance to each of those core exercise movements, except the leg raise.

The ROM device is an expensive device that in today's world costs on the order of $15,000.

Applicant believes there is a need, and a market, for an exercise device that can produce a workout that includes not only the 6 core exercise movements that the ROM enables, but that provides additional features not found in the ROM, and which can also enable a user to perform additional important exercise movements, in a relatively short workout time, and which costs the user significantly less than the ROM currently costs.

The device and method of the present invention is designed to enable a user to perform at least 8 important exercise movements (referred to herein as core exercise movements), with variable resistance applied to each core exercise movement. The 8 core exercise movements are (a) bench press and row, (b) military press and lat pull down, (c) crunch and dead lift, and (d) step and leg raise.

In addition, the exercise device of the present invention is designed to enable a user to get a complete workout of the 8 core exercise movements, in a time frame comparable to the type of time frame of the ROM, and with a device that is considerably less costly than the ROM.

Still further, the exercise device of the present invention is designed so that the user can set the amount of variable resistance that the user wants to apply to at least 6 of the core exercise movements, and then perform all of those 6 core exercise movements from a seated position on the device, without needing to reset the variable resistance. This enables the user to efficiently perform the 6 core movements, in a relatively short amount of time, from the seated position.

In this application, a "variable resistance" structure connected between the frame and a component means structure that provides resistance to movement of the component in opposite directions relative to the frame that varies with the amount of force exerted by a user against a component in either of the opposite directions. Thus, as user increases his/her effort to move the component in one of the opposite directions the resistance to that movement increases. Therefore, as a user performs core exercise movements that require movement of a component in opposite directions, the variable resistance structure between the component and the frame provides resistance that varies with the amount of force exerted by a user on the component in each of the opposite directions, thereby providing variable resistance to each core movement performed by a user on the exercise device.

Applicant's concept for providing variable resistance to each of the foregoing 8 core exercise movements is believed to provide significant exercise benefits, even in relation to the ROM device. For example, applicant's exercise device provides variable resistance to the leg raise exercise movement, and applicant believes the ROM device does not provide resistance to the leg raise movement. In addition, applicant's device provides variable resistance to a military press and lat pull down exercise movements, and applicant believes it would require a significant remake of the ROM device to add a military press and lat pull down exercise structure to the device.

Other features of the present invention will become further apparent from the following detailed description and the accompanying drawings and exhibits.

BRIEF DESCRIPTION OF THE DRAWINGS AND EXHIBITS

Figure 4:
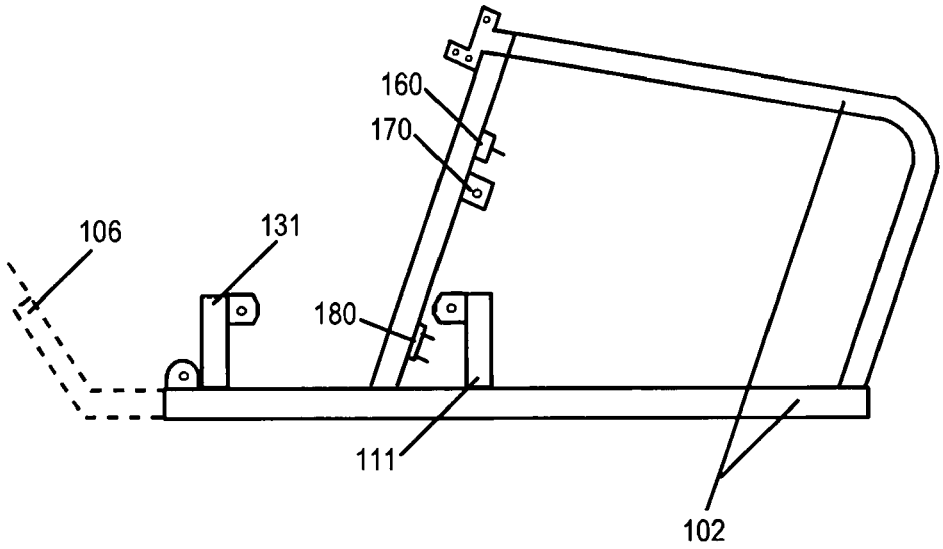
FIG. 4 is a side view of a frame for an exercise device, according to the present invention.
Figure 5A:
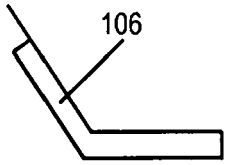
FIG. 5 is a top view of the frame of FIG. 4.
Figure 5:
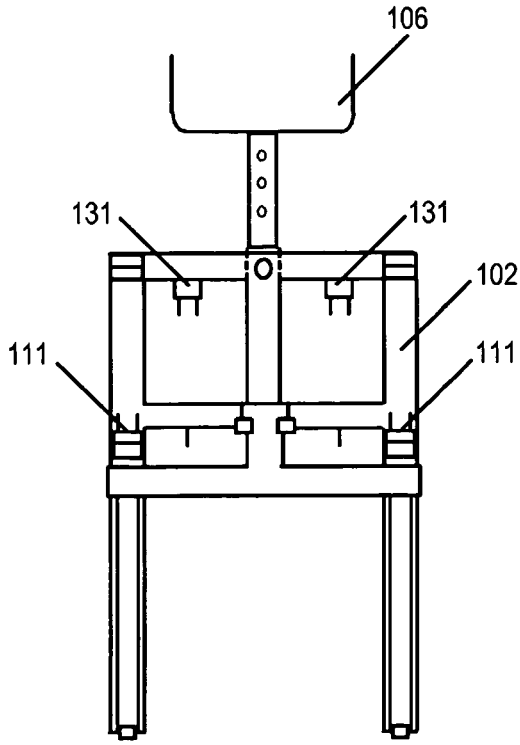
Figure 6A:
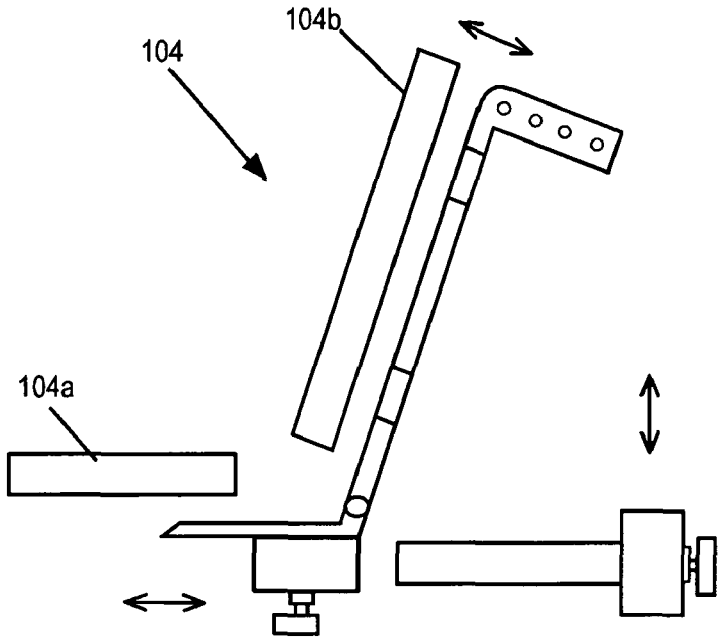
Figure 6B:
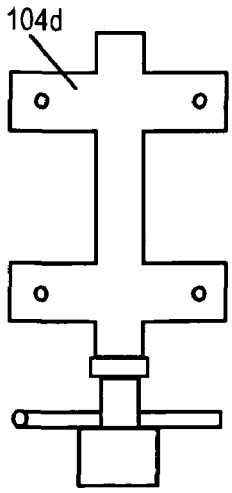
Figure 6C:
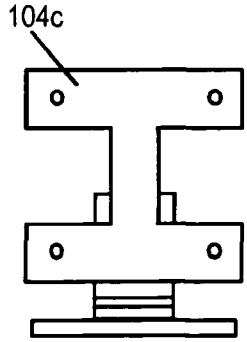
Figures 7A, 7B, 7C, 7D, 7E, 7F, 7G:
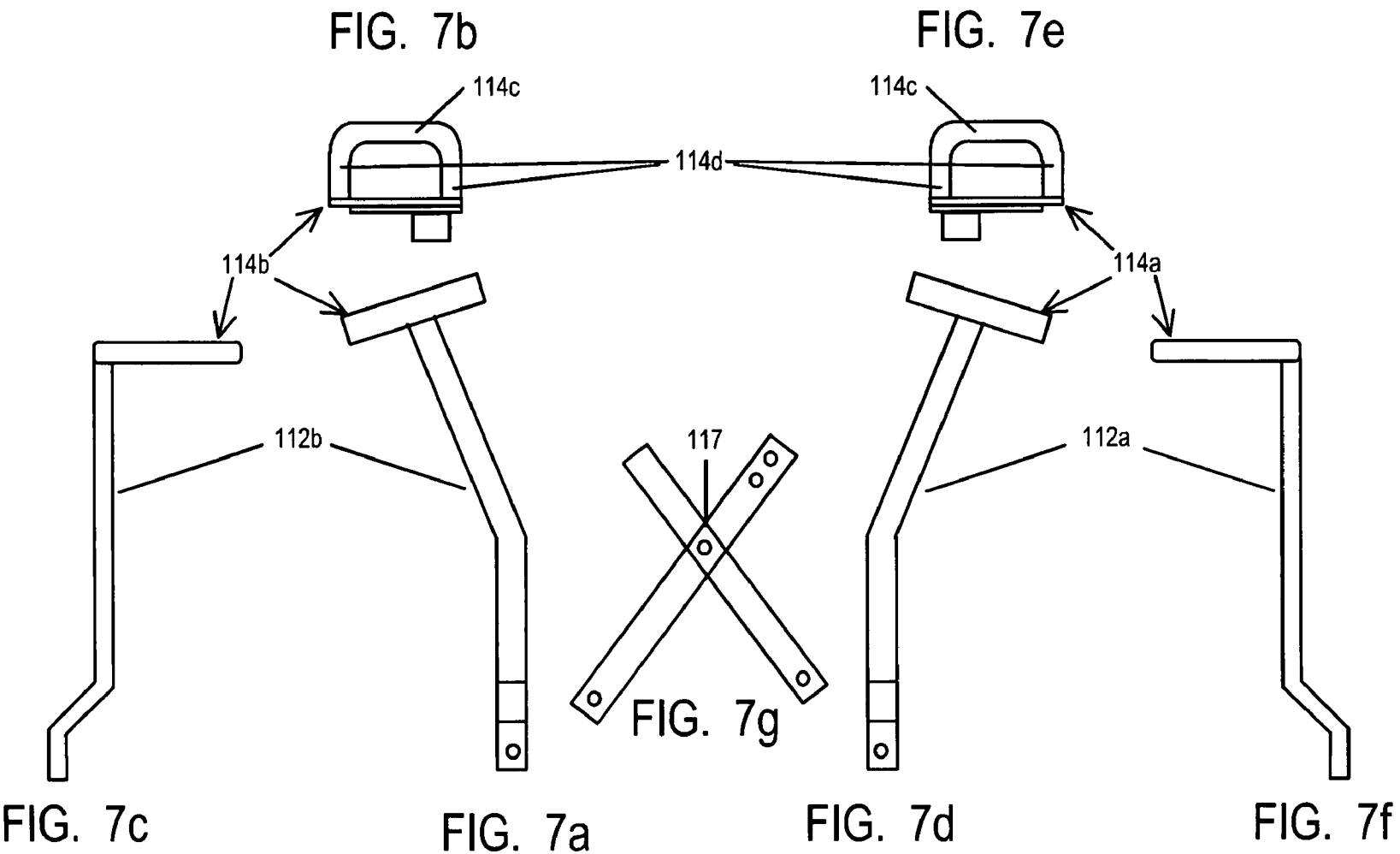
Figures 8A, 8B, 8C, 8D, 8E, 8F, 8G, 8H, 8I, 8J, 8K, 8L:
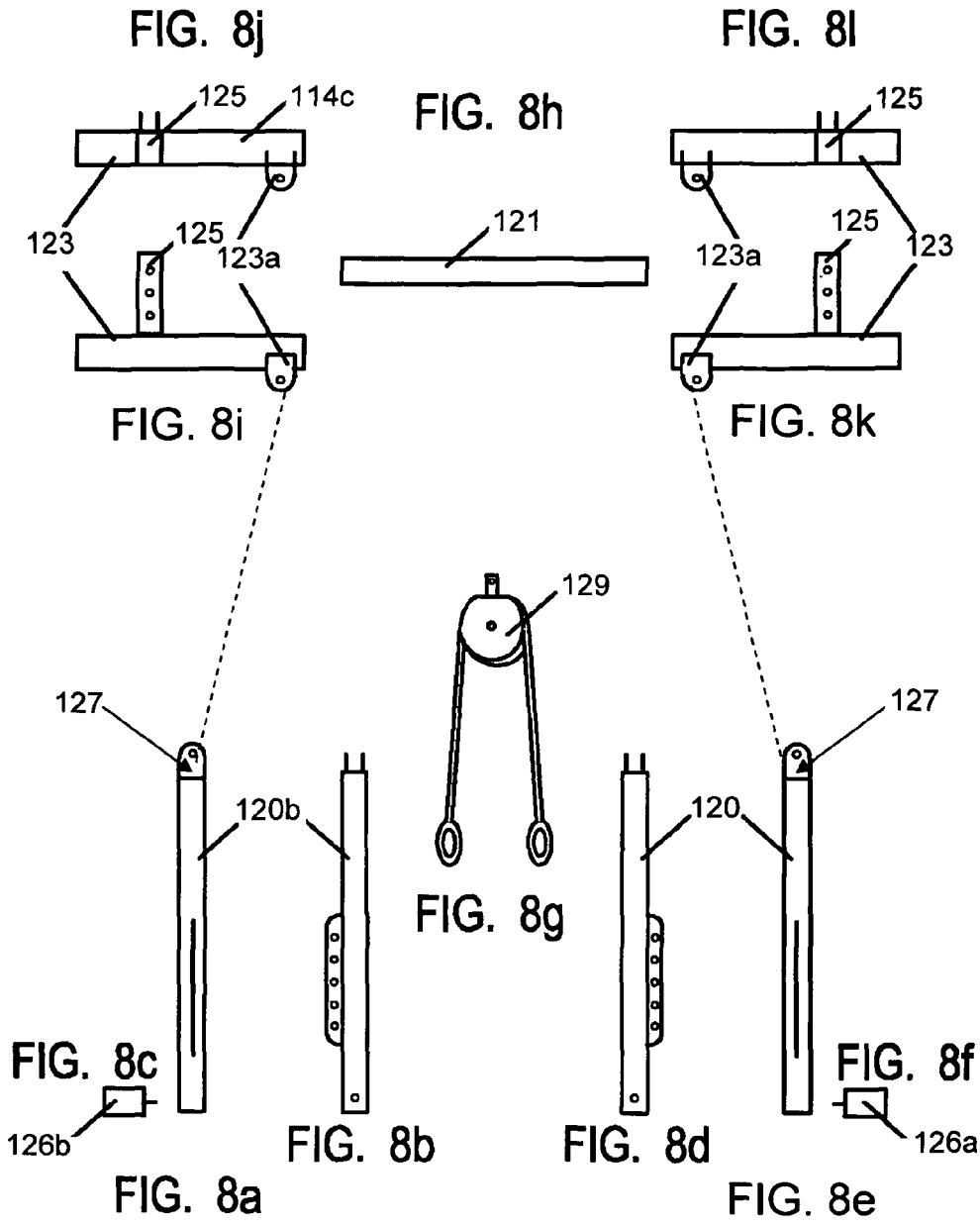

FIG. 5*a* is a side view of the footrest in the exercise device of FIGS. 4 and 5;

FIG. 6*a* is an exploded view of components for assembling a seat in the frame of FIGS. 1-5;

FIGS. 6*b* and 6*c* are back and bottom views, respectively, of seat frame structures for the exercise device of FIGS. 1-5;

FIGS. 7*a*-7*g* are exploded views of components for performing military press and lat pull down core exercise movements, in an exercise device according to the present invention; FIGS. 7*a*-7*c* being rear, top and side views of the left arm structure, FIGS. 7*d*-7*f* being rear top and side views of the right arm structure, and FIG. 7*g* being a rear view of the structure that connects the left and right arm structures, and is also connected to the frame and the variable resistance structure for the military press and lat pull down movements;

FIGS. 8*a*-8*l* are exploded views of components for performing step and leg raise exercise movements, in an exercise device according to the present invention.

Figure 10:
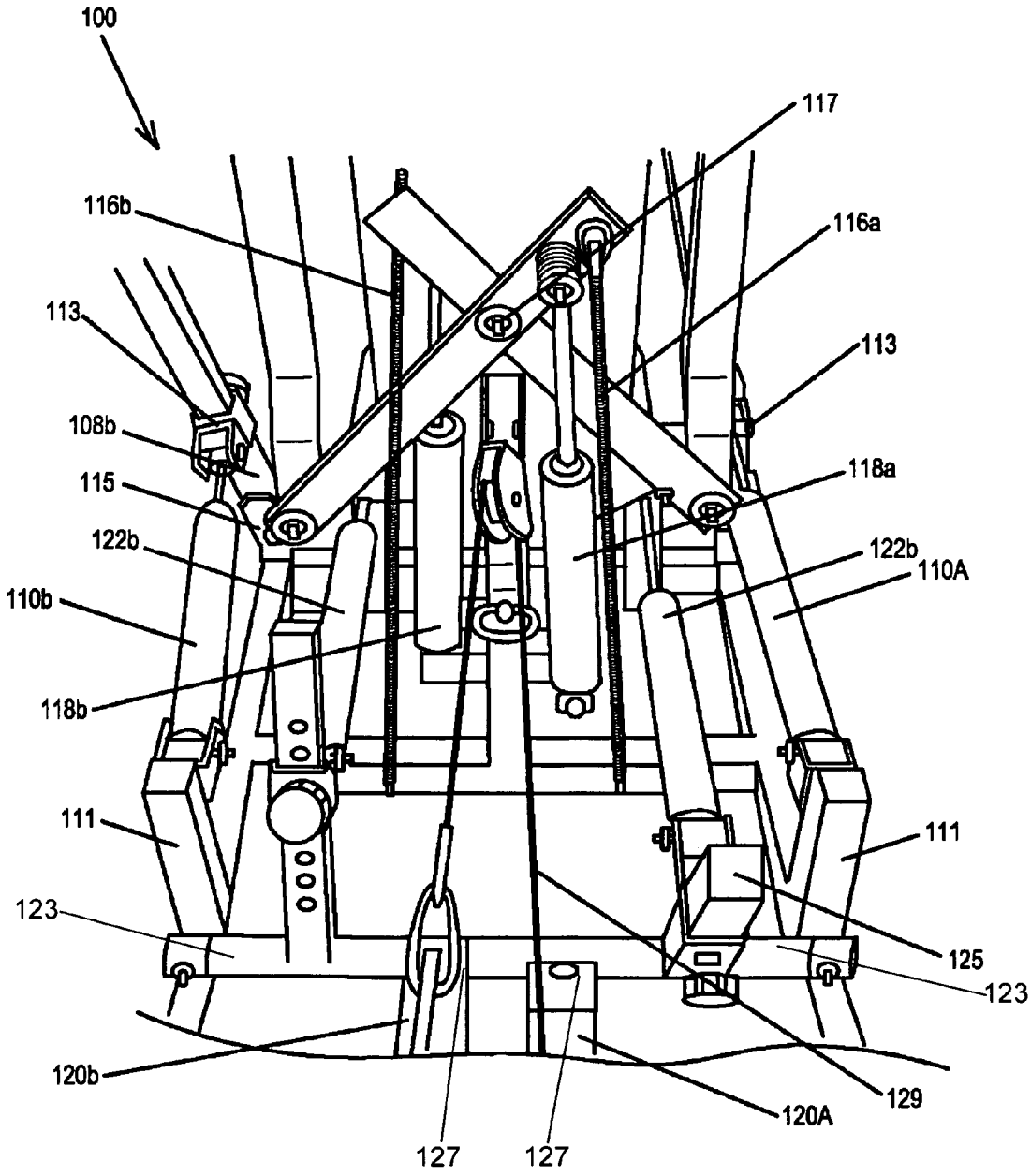
Figure 11:
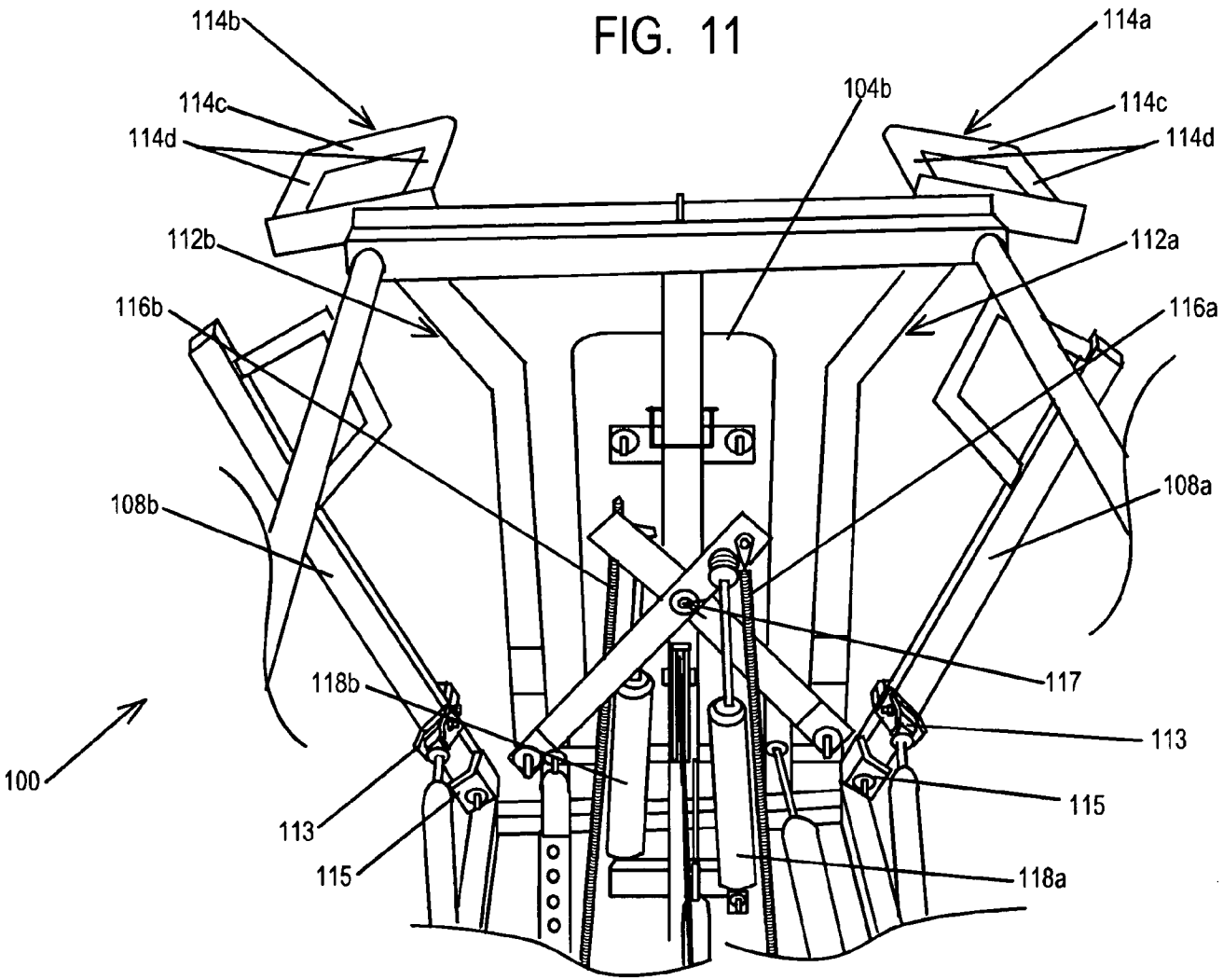

FIGS. 9*a*-9*f* are exploded views of components for assembly into the exercise device, for performing bench press, row, crunch and dead lift exercise movements, in an exercise device according to the principles of the present invention, with some exemplary dimensions thereon; and FIGS. 10-11 are close up images of certain of the components, as assembled into the exercise device.

Exhibits A-G are illustrations of a user performing bench press and crunch, and dead lift and row core exercise movements with an exercise device according to the present invention (Exhibits A-E taken from the side of the device and Exhibits F and G taken from the front of the device, facing the user);

Exhibits H-K are illustrations of a user performing military press and lat pull down core exercise movements with an exercise device according to the present invention (Exhibits H and I taken from the side of the device, and Exhibits J and K taken from the front of the device, facing the user);

Exhibits L and M are illustrations of the manner in which a user can perform additional exercise movements in which the user individually operates certain of the components of the device, while seated on the device, in accordance with the principles of the present invention; and Exhibits N-Q are illustrations of a user performing step and leg lift core exercise movements with an exercise device according to the present invention.

DETAILED DESCRIPTION

As discussed above, the present invention relates to a new and useful exercise device and method designed to enable a user to perform at least 8 core movements, with variable resistance applied to each core movement. The 8 core movements are (a) bench press and row, (b) military press and lat pull down, (c) crunch and dead lift, and (d) step and leg raise. An exercise device according to the principles of the present invention is described herein in connection with those 8 core exercise movements, but it will be clear to those in the art that the exercise device can also be used for various other exercise movements.

FIGS. 1-3, 10 and 11 show an overview of an exercise device 100 constructed according to the principles of the present invention. The exercise device 100 includes a frame 102 and exercise structure secured to the frame (and described below) that enables a user to perform exercise movements with the exercise device, The exercise structure is configured to enable a user to perform a plurality of exercise movements, including at least the following 8 core exercise movements, while providing variable resistance to each of the exercise movements:

Bench press and row
Military press and lat pull down
Crunch and dead lift
step and leg raise.

The exercise structure includes a seat 104 connected with the frame 102 in a manner enabling a user to sit in an upright position as the user begins some of the core exercise movements. The seat 104 comprises a seat cushion 104*a* and a back rest 104*b*, supported on respective frame members 104*c*, 104*d*. A foot rest 106 is connected with the frame 102 in a manner that enable a user's feet to press against the footrest when the user is seated and performing certain of the exercise movements on the exercise device.

A first pair of arms 108*a*, 108*b* are pivotally connected with the frame 102 in a manner that enables the arms to pivot in opposite directions between a rear position when a user is seated upright on the seat 104 and a forward position as the user performs bench press, crunch, dead lift and row exercise movements while seated on the seat. In accordance with the invention, first variable resistance structure is connected with the frame and the first pair of arms 108*a*, 108*b* in a manner that provides variable resistance to pivotal movement of the first pair of arms in both opposite directions as the user performs any of the bench press and row, and crunch and dead lift core exercise movements.

Figure 1:
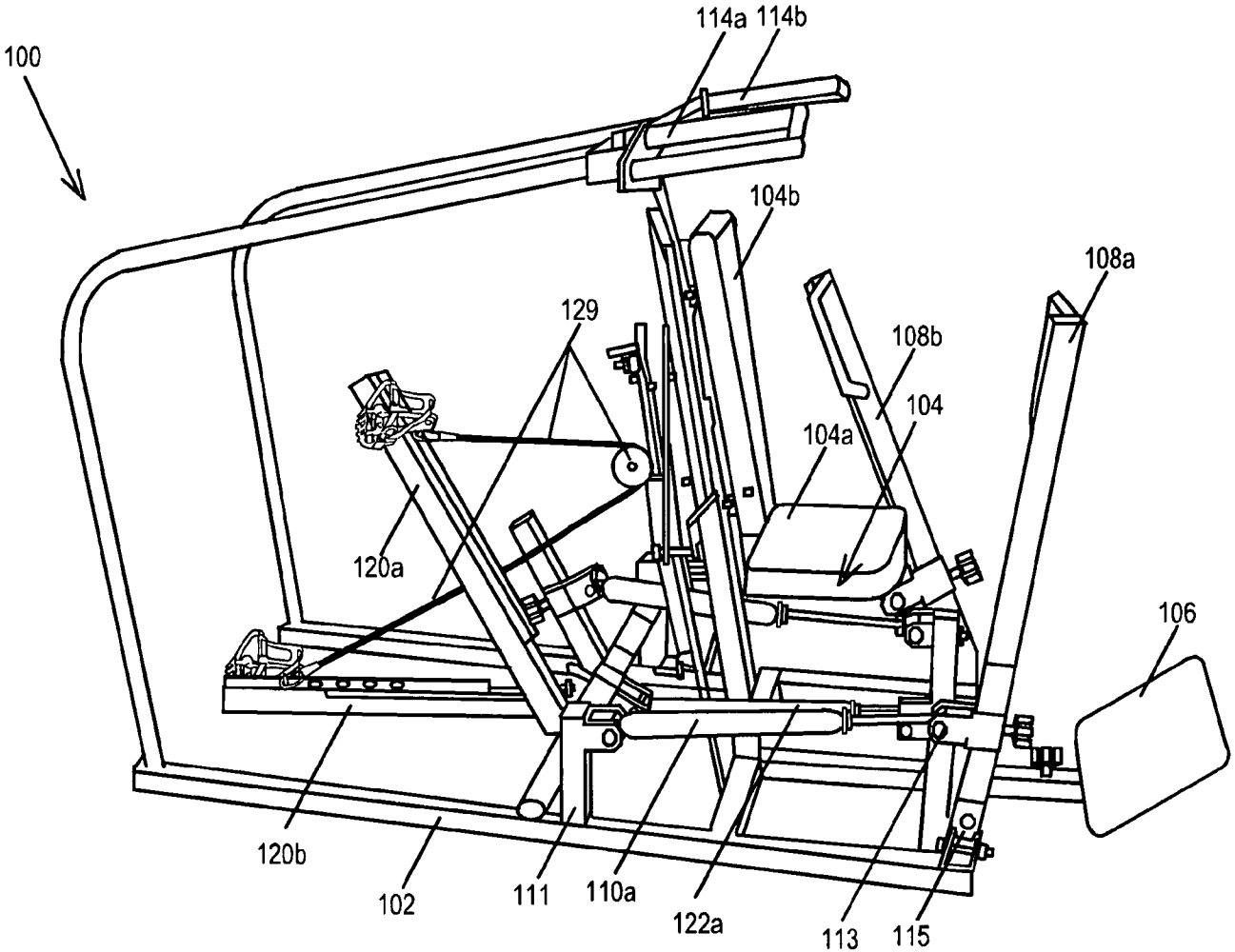
FIG. 1 is a three dimensional view of an exercise device, according to the principles of the present invention, taken from one orientation.
Figure 2:
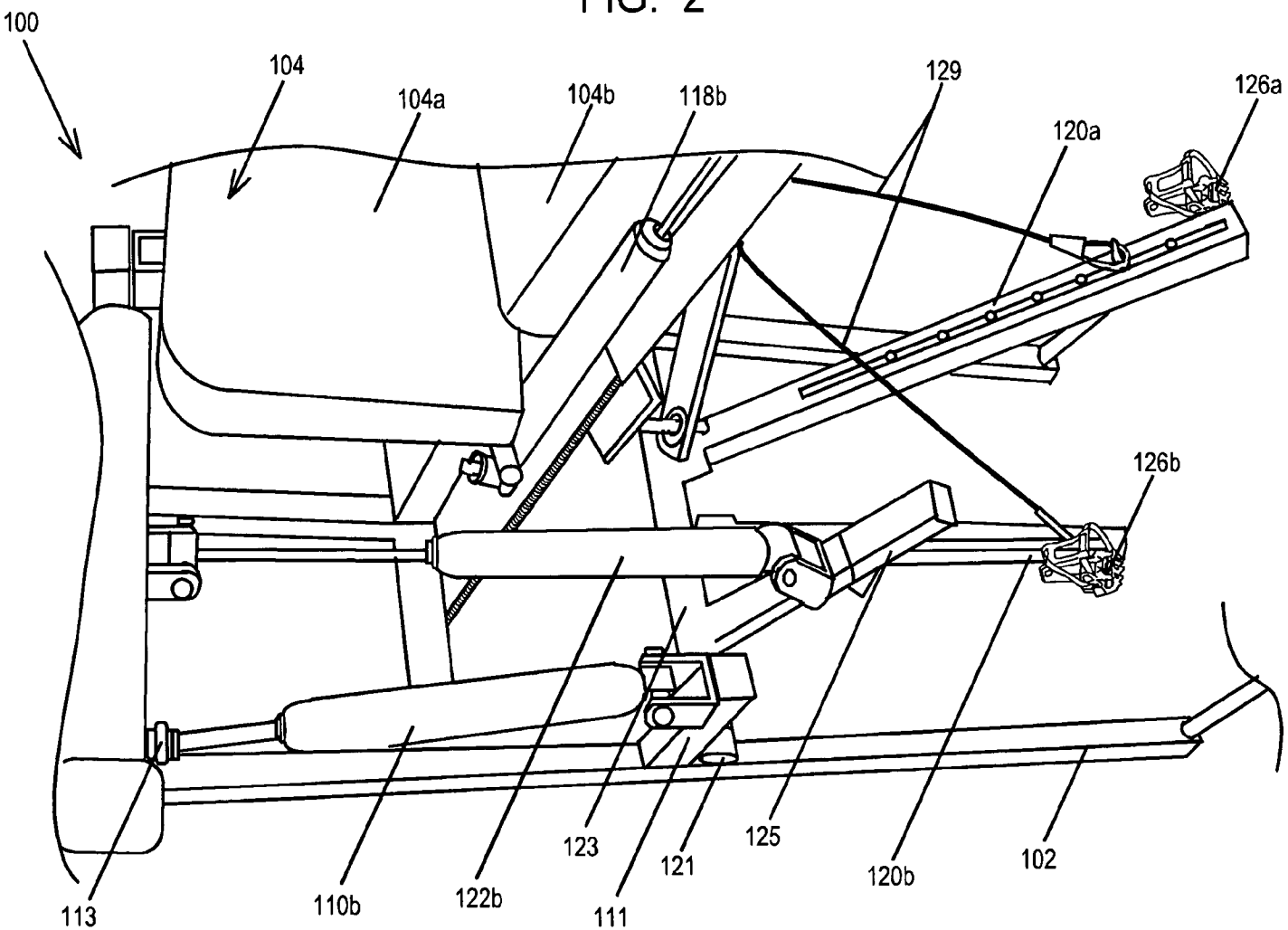
FIG. 2 is a three dimensional view of part of the exercise device, according to the principles of the present invention, taken from another orientation.
Figure 3:
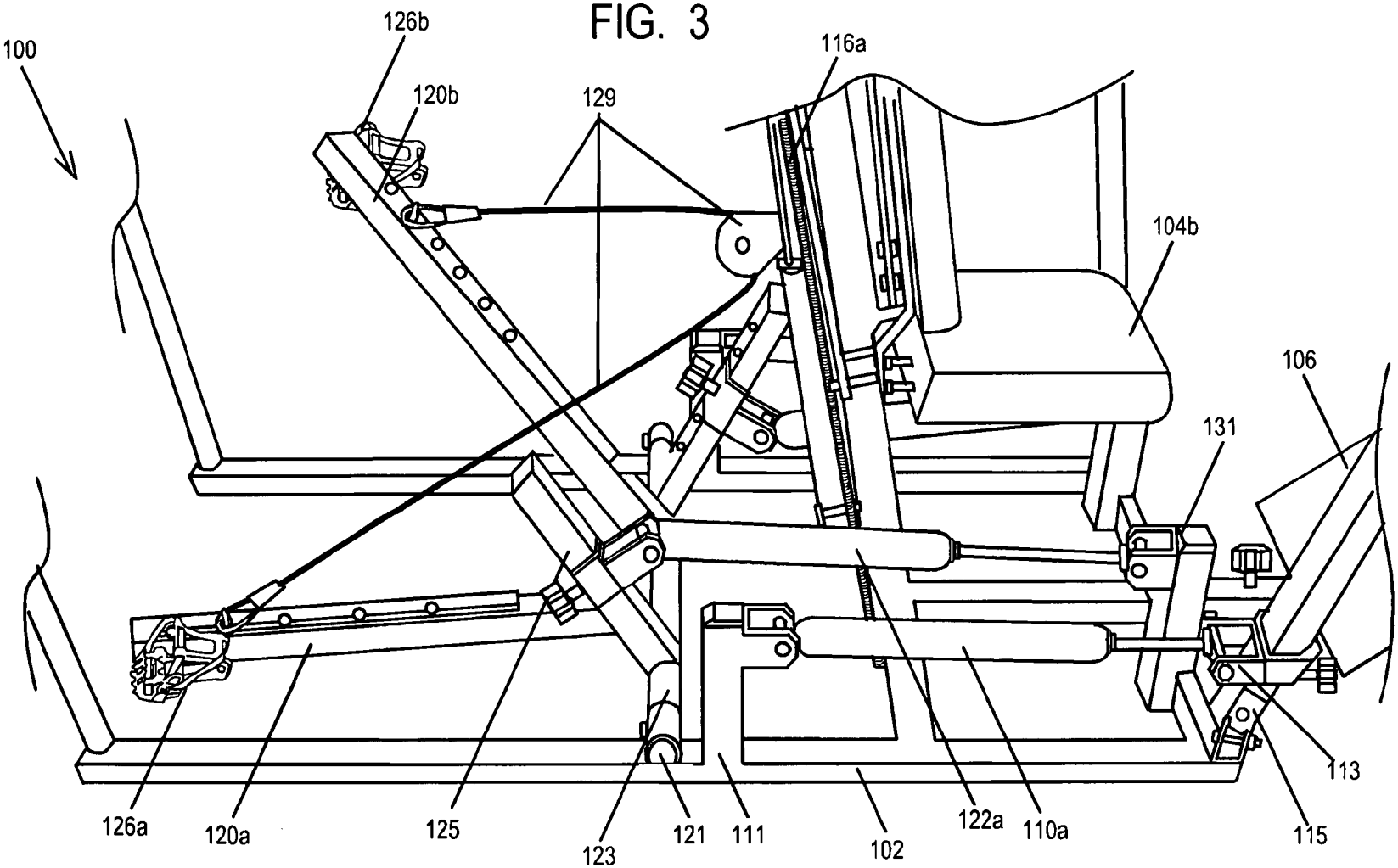
FIG. 3 is a three dimensional view of part of the exercise device, according to the principles of the present invention, taken from still another orientation.

In the illustrated embodiment, the first variable resistance structure comprises a pair of shocks 110*a*, 110*b*, connected between respective arms 108*a*, 108*b* and the frame 102. An example of suitable shocks are Rancho brand shocks, model RS5406 (valved 50/50). The shocks 110*a*, 110*b*, each enables a respective arm 108*a*, 108*b*, to pivot from an upward orientation to a forward orientation as a user performs the core exercise movements of bench press and row and crunch and dead lift with the exercise device. FIGS. 2, 3 and 11 further show the manner in which the shocks 110*a*, 110*b* are supported on the device. Specifically, each shock is connected between a post 111 on the frame and a joint 113 on a respective arm. By adjusting the location of the shocks along the arms 108, the level of resistance of the shocks to movement of the arms can be selectively adjusted.

Further in accordance with the principles of the present invention, each of the first pair of arms 108*a*, 108*b* is connected with the frame and the first variable resistance structure in a manner that enables the each of the first pair of arms to be pivoted to a forward position that is past the level of foot rest 106 as the user does a bench press and forward extension while seated on the seat 104.

In addition each of the first pair of arms 108*a*, 108*b*, is connected with the frame 102 and the first variable resistance structure 110*a*, 110*b* in a manner configured to allow each or the pair of arms to pivot between a rear and forward position independently of the other arm as the user performs any of the bench press and row, and crunch and dead lift core exercise movements.

Further, the arms 108*a*, 108*b* have respective handles 109*a*, 109*b* configured so that a user performing bench press and row, and crunch and dead lift exercise movements, can grip either of several different portions of the handles 109*a*, 109*b*. Specifically, each of the handles has a bar 109*c* that extends in one direction, and a pair of bars 109*d* that extend transverse to the bar 109*c*.

Also, the connection between the first pair of arms 108*a*, 108*b* and the frame 102 comprises universal joints 115 between each of the first pair of arms and the frame. Those universal joints enable each of the first pair of arms 108*a*, 108*b* to have lateral flexibility, in the sense that the arms can pivot laterally relative to a user seated in the seat (i.e. laterally outward, as opposed to forward and rearward). Such lateral flexibility forces the user to exercise the user's stabilizer muscles, and also enables the arms 108*a*, 108*b* to allow, and to follow, the natural movements of a user during the bench press and row and crunch and dead lift core exercise movements. In this application this feature is referred to as "lateral flexibility".

The manner in which a user can perform bench press and row, and crunch and dead lift exercise movements can be specifically seen with respect to Exhibits A-H. The user starts with his/her back against the seat back, with hands on the handles (Exhibit A). The user then performs a bench press with the handles, moving the handles forward (and together) until the arms are extended (Exhibit B). With the arms extended, the user then continues with a crunch (Exhibit C), using the abs to extend the upper body forward and stretch forward with the arms. In performing the crunch, the arms can be pivoted forward far enough such that they can extend past the vertical height of the foot rest. Thus, as described in this application as the user performs a crunch the arms can pivot far enough forward to extend at least even with, and preferably past the leg rests, so that a really good stretch is possible during the crunch movement. After performing a crunch, the user can then straighten his/her back and perform a dead lift (with the arms still straight) until the user's back touches the seat back (Exhibit D) and then pull arms back beside chest in a rowing movement (Exhibit E). From the front views of Exhibits F and G, it can be seen that the universal connections between the bottoms of the arms and the frame enable each of the first pair of arms 108*a*, 108*b* to have lateral flexibility, in the sense that the arms can pivot laterally relative to a user seated in the seat (i.e. laterally outward, as opposed to forward and rearward). Such lateral flexibility forces the user to exercise the user's stabilizer muscles, and also enables the arms 108*a*, 108*b* to allow, and to follow, the natural movements of a user during the bench press and row and crunch and dead lift core exercise movements. In this application this feature is referred to as "lateral flexibility". Still further, note from Exhibit M that the user can also perform the foregoing movements individually with the arms.

The exercise structure further includes a second pair of arms 112*a*, 112*b* connected to the frame 102 and to second variable resistance structure in a manner that enables a user who is seated in the seat to perform a military press and lat pull down while the second variable resistance structure provides variable resistance to the movements of the second pair of arms as the user performs any of the military press and lat pull down exercise movements. The second pair of arms 112*a*, 112*b*, include handles 114*a*, 114*b* at the upper ends of the arms 112*a*, 112*b*, and a pivotal joint 117 is coupled to both arms 112*a*, 112*b*, to enable the arms to conveniently move up and down as the user performs the military press and lat pull down core exercise movements while seated in the seat 104. The second variable resistance structure comprises a second pair of shocks (an example of suitable shocks are Rancho brand shocks, 118*a*, 118*b*, RS99112 adjustable (70/30)), each of which extends between and is connected to the bottom of the frame 102 and the portion of the joint 117 connected to a respective arm 112*a*, 112*b* (see e.g. FIG. 11). The shocks 118*a*, 118*b* are different from the shocks 114*a*, 114*b*, because the 70/30 ratio of the resistance provided by the shocks 118*a*, 118*b* is designed to provide lower resistance to the military press movement than to the lat pull down movement. This is because with most users the capability to perform the lat pull down movement is generally greater than the capability to perform the military press movement. In addition, the shocks 118*a*, 118*b* are designed to enable their relative resistance to be selectively adjusted (by adjustment devices on the shock housings), and their points of connection to the joint 117 and/or the frame can be selectively adjusted, to further adjust their resistance, whereas the shocks 110*a*, 110*b* do not have different relative resistance, and their resistance is adjusted by their points of connection to the arms 108*a*, 108*b* and the frame 102. Removable springs 116*a*, 116*b*, which can extend between the joint 117 and the frame, can be provided, to give the user a degree of assistance during the military press, and additional resistance during the lat pull down, to further account for the fact that a user's ability to perform the lat pull down is often greater than the user's ability to perform the military press.

The handles 114*a*, 114*b* are configured so that a user performing military press and lat pull down exercise movements can grip either of several different portions of the handles 114*a*, 114*b*. Specifically, each of the handles has a bar 114*c* that extends in one direction, and a pair of bars 114*d* that extend transverse to the bar 114*c*.

The manner in which a user can perform military press and lat pull down core exercise movements with the exercise device can be appreciated from Exhibits H-K. The user grabs the military press handles (from the position of Exhibit H to the position of Exhibit I), either by the bars 114*c* or the bars 114*d*, and presses up for the military press movement, (from the position of Exhibit I to the position of Exhibit H), and then pulls down for the lat pull down exercise. Also, the pivotal joint 117 enables the arms to be pivoted outwardly during the military press and lat pull down movement (Exhibits J, K), to provide lateral flexibility during that exercise movement. Also, it will be apparent that any adjustments of the resistance to either of the bench press and crunch, dead lift and row, and military press and lat pull down movements can be done before the user is seated, so that the user can go through all of those movements without further adjusting the apparatus.

The exercise device 100 is also configured to enable a user to perform step and leg lift movements, while providing variable resistance to such core exercise movements. As seen from FIGS. 8*a*-8*l*, and 10-12, a pair of leg members 120*a*, 120*b* each extends away from a horizontal bar 121 that is located toward the bottom of the frame. Each of the leg members 120*a*, 120*b*, has a respective sleeve 123 that surrounds the bar 121 and can pivot about the bar 121, so that each leg member 120*a*, 120*b* can pivot about the axis of the horizontal bar 121. Third variable resistance structure extends between the pair of leg members and the frame, in the form of shocks 122*a*, 122*b*, that extend between mounts 125 on the sleeves 123 and mounts 131 connected with the frame 102 (see e.g. FIGS. 4, 2, 3 and 10). (For shocks 122*a*, 122*b* an example of suitable shocks are the Rancho brand shocks, model RS5406 (valved 50/50).) Also, each leg member 120*a*, 120*b* has a respective petal 126*a*, 126*b*, which effectively forms a stirrup for a user's foot at the end of the leg member. In addition, a cable and pulley 129 is connected with each of the leg members 120*a*, 120*b*, to provide the leg members with some stability and to provide some minimal assist during the step and leg raise exercise movements. The cable 129 can be connected to different locations along the leg members, to adjust the step height (see e.g. FIG. 3). Still further, the connection between the sleeve mounts 123*a* and the leg members comprise joints 127 that allow some lateral flexibility to the leg members during the step and leg lift movements. Thus, as should be clear from the foregoing description, each of the pair of leg members extends away from a pivot axis on the frame and is pivotal relative to the pivot axis between upper and lower positions as a user performs the step and leg raise movements, and the third variable resistance structure provides resistance to movement of each of the leg members from an upper position to a lower position and from a lower position to an upper position as the user performs any of the step and leg raise exercise movements. In addition, each of the leg members is mounted to a respective sleeve mount 123*a* in a manner (e.g. via a joint 127) that enables each leg member to have a degree of lateral flexibility as the user performs the step and leg raise movements.

The manner in which a user performs the step and leg raise exercise movements, with the exercise device of the present invention, can be seen in Exhibits N-Q. The user starts with leg in the stirrups, with one leg member raised and the other lowered (Exhibit N). The user pushes down on the raised leg, against the variable resistance, to begin a step, while the other leg begins a leg raise, also against the variable resistance (Exhibit O). As, the step and leg raise continue, against the variable resistance (Exhibit P), until they are completed (Exhibit Q), and the user can then continue the step and leg raise with the other leg. Note that the user's feet are in the stirrups of the pedals, and that the user encounters variable resistance in both legs from both the step with one leg and the leg raise with the other leg. Note also that the joints between the sleeve mounts and the leg members enables each of the leg members to have lateral flexibility, in the sense that the leg members can pivot laterally outward, during the step and leg lift movements. Such lateral flexibility forces the user to exercise the user's leg stabilizer muscles, and also enables the leg members to allow, and to follow, the natural movements of a user's joints during the step and leg lift core exercise movements, to provide the feature referred to in this application as "lateral flexibility".

Thus, the foregoing description shows how a user can perform at least 8 core exercise movements with the exercise device of the present invention. Moreover, it should be clear that at least 6 of those core exercise movements, i.e. bench press and row, crunch and dead lift, military press and lat pull down, can be performed while the user is seated in the seat 104, and without having to change or adjust the variable resistance provided to each of those core exercise movements.

Also, the exercise device has been designed so that a user can get a complete core exercise workout, involving those core exercises, in a relatively short amount of time. Thus is primarily because of the variable resistance structure that produces resistance to all movements during the core exercises, and in a manner that is variable in accordance with the effort exerted by the user. In a manner similar to the ROM, the present invention is designed to provide a user with a complete core exercise sequence in a matter of minutes using the exercise device.

Thus, with the exercise device of the present invention, a user can get a complete core workout, by determining and providing whatever predetermined variable resistance the user desires to each of the core 6 exercise movements that a user can perform while seated on the device, and performing those 6 core exercise movements, in a sequence determined by the user, and without requiring readjustment of the variable resistance. Moreover, the exercise device enables a user to perform step and leg raise exercise movements, with variable resistance to both the step and leg raise movements.

The following additional features of the present invention should be noted:

a. The shocks that provide the variable resistance is each formed by a housing with a stem extending partially out of the housing. The housing is connected to the frame or the exercise component, and the stem is connected to the other of the frame or the exercise component. The stem can move linearly into and out of the housing as the user performs exercise movements, and fluid inside the housing interacts with the stem structure located inside the housing to provide variable resistance to movement of the stem into the housing and out of the housing. This provides the basic variable resistance of the shocks to the exercise movements.

b. In addition, the exercise device is designed so that the shock housing or the stem can be located at different locations on one of the frame or the exercise component, to adjust the lever arm provided by the shock to movement of the stem and housing, thereby allowing additional adjustment of the variable resistance provided by the shock to the exercise movements. Specifically, various components have a plurality of openings that can be engaged by a pull pin associated with a shock, to adjust the leverage point of the shock on the frame. This feature enables the amount of effort required to move an exercise component against the resistance of the shock, and also enables the speed with which the exercise component can move against the resistance of the shock to be adjusted.

c. As seen from Figures, the frame has shock mounts 131 for the shocks associated with the leg members 120*a*, 120*b*, and shock mounts 111 for the shocks associated with the arm members 108*a*, 108*b*. In addition, the frame has a mount 160 for the shoulder pivot joint, and a mount 170 for the pulley associated with the leg members, and a mount 180 for the shocks associated with the military press and lat pull down movements.

d. The exercise structure is designed to enable the user during a bench press and crunch movement, to pivot the arms forward to positions beyond the location of the footrest. This feature enables a user to get a very significant stretch during the crunch movement.

e. The exercise structure is designed to enable a user to operate each of the arms independently of the other arm during the bench press, row crunch and dead lift type of exercise movements, which further enhances the range of exercise movements that can be provided by the exercise structure.

f. The hand grips used for the bench press and crunch, dead lift and row, and military press and lat pull down movements are designed so that a user can select which of the hand grips the user wants or is able to use in performing those core exercise movements. In the applicant's experience, users prefer the ability to select which of the hand grips to use, to enable the users to perform the exercise movements.

g. The step and leg raise exercise structure is believed to be particularly unique, because it is believed to be the first exercise structure that provides variable resistance to the leg raise exercise movement. In applicant's experience, most step type exercise structures provide resistance to a downward step exercise movement, but also provide a spring that returns the leg structure to a position that allows another downward step. With the exercise device of the present invention, while the pulley provides a small amount of assistance in initiating the leg raise movement, the entire leg raise movement is performed against the variable resistance of the shocks. The user must perform the leg raise exercise movement to return the leg member to a position to perform a step movement.

h. In each of the exercise movements, a range of lateral flexibility is provided, that further develops the user's joint flexibility, and also enables the user to perform the various exercise movements with the natural joint physiology of the human body.

Accordingly, with the foregoing disclosure in mind, it is believed that various adaptations of an exercise device and method, according to the principles of the present invention, will be apparent to those in the art.

The invention claimed is:

1. An exercise device comprising a frame and exercise structure secured to the frame that enable a user to perform exercise movements with the exercise device, the exercise structure configured to enable a user to perform a plurality of exercise movements, including at least the following exercise movements, while providing variable resistance to each of the exercise movements:

Bench press and row,

Military press and lat pull down,

Crunch and dead lift;

wherein the exercise structure is further configured to enable a user to perform step and leg raise exercise movements, while providing variable resistance to each of such exercise movements;

wherein the exercise structure includes a frame, a seat connected with the frame and a foot rest connected with the frame in a manner that enable a user's feet to press against the footrest when the user is seated and performing certain of the exercise movements on the exercise apparatus, and the exercise structure includes a first pair of arms that are pivotally connected with the frame and pivotal in opposite directions between a rear position when a user is seated on the seat and a forward position as the user performs any of the bench press and row and crunch and dead lift exercise movements while seated on the seat, and a first variable resistance structure connected with the frame and the first pair of arms in a manner that provides variable resistance to pivotal movement of the first pair of arms in both opposite directions as the user performs any of the bench press and row, and crunch and dead lift core exercise movements;

wherein the exercise structure further includes a second pair of arms connected to the frame and to a second variable resistance structure in a manner that enables a user who is seated in the seat to perform military press and lat pull down exercise movements while the second variable resistance structure provides variable resistance to the movements of the second pair of arms as the user performs any of the military press and lat pull down exercise movements, wherein the second variable resistance structure comprises a pair of shocks, each of which has a fluid housing and a stem that extends into the fluid housing and is acted upon by fluid in the fluid housing to provide variable resistance to forces that are applied to the stem in opposite directions, and wherein the fluid housing and the stem of each of the shocks are attached to respective portions of one of the second pair of arms and the frame to provide the variable resistance, and wherein the fluid housing can be adjusted to provide additional adjustment of the resistance applied by either or both of the shocks to either or both of the second pair of arms; and wherein each of the second pair of arms is connected with the frame in a manner that allows lateral flexibility of the second pair of arms as a user performs any of the military press, and lat pull down exercise movements.

2. An exercise device comprising a frame and exercise structure secured to the frame that enable a user to perform exercise movements with the exercise device, the exercise structure configured to enable a user to perform a plurality of exercise movements, including at least the following exercise movements, while providing variable resistance to each of the exercise movements:

Bench press and row,

Military press and lat pull down,

Crunch and dead lift;

wherein the exercise structure is further configured to enable a user to perform step and leg raise exercise movements, while providing variable resistance to each of such exercise movements;

wherein the exercise structure includes a frame, a seat connected with the frame and a foot rest connected with the frame in a manner that enable a user's feet to press against the footrest when the user is seated and performing certain of the exercise movements on the exercise apparatus, and the exercise structure includes a first pair of arms that are pivotally connected with the frame and pivotal in opposite directions between a rear position when a user is seated on the seat and a forward position as the user performs any of the bench press and row and crunch and dead lift exercise movements while seated on the seat, and a first variable resistance structure connected with the frame and the first pair of arms in a manner that provides variable resistance to pivotal movement of the first pair of arms in both opposite directions as the user performs any of the bench press and row, and crunch and dead lift core exercise movements, further including a pair of leg members connected with the frame and with a second variable resistance structure extending between the pair of leg members and the frame, each of the pair of leg members being extending away from a pivot axis on the frame and being pivotal relative to the pivot axis between upper and lower positions as a user performs step and leg raise exercise movements, and the second variable resistance structure providing resistance to movement of each of the leg members from an upper position to a lower position and from a lower position to an upper position as the user performs any of the step and leg raise exercise movements;

wherein the second variable resistance structure comprises a pair of shocks, each of which has a fluid housing and a stem that extends into the fluid housing and is acted upon by fluid in the fluid housing to provide variable resistance to forces that are applied to the stem in opposite directions, and wherein the fluid housing and the stem of each of the shocks are attached to respective portions of one of the pair of leg members and the frame to provide the variable resistance, and wherein the attachment locations of either or both of the fluid housings and either of the pair of leg members can be selectively adjusted to provide additional adjustment of the resistance applied by either or both of the shocks to either or both of the leg members; and wherein each of the pair of leg members is connected with the frame in a manner that allows lateral flexibility of the first pair of leg members as a user performs any of the step and leg raise exercise movements.

* * * * *